US009815180B2

(12) United States Patent
Lukes et al.

(10) Patent No.: US 9,815,180 B2
(45) **Date of Patent: *Nov. 14, 2017**

(54) TORQUE TRANSMISSION DRIVER

(71) Applicant: INFASTECH INTELLECTUAL PROPERTIES PTE. LTD., Singapore (SG)

(72) Inventors: Richard W. Lukes, Calmar, IA (US); Brian Leuenberger, Fort Atkinson, IA (US)

(73) Assignee: Infastech Intellectual Properties, PTE. LTD., Singapore (SG)

( * ) Notice: Subject to any disclaimer, the term of this patent is extended or adjusted under 35 U.S.C. 154(b) by 451 days.

This patent is subject to a terminal disclaimer.

(21) Appl. No.: 14/148,650

(22) Filed: Jan. 6, 2014

(65) Prior Publication Data

US 2014/0116210 A1 May 1, 2014

Related U.S. Application Data

(63) Continuation of application No. 13/947,014, filed on Jul. 19, 2013, now Pat. No. 9,682,464, which is a (Continued)

(51) Int. Cl.
*B25B 15/00* (2006.01)
*B25B 15/02* (2006.01)
(Continued)

(52) U.S. Cl.
CPC ..... *B25B 15/001* (2013.01); *B25B 15/004* (2013.01); *B25B 15/005* (2013.01);
(Continued)

(58) Field of Classification Search
CPC ..... B25B 15/001; B25B 15/02; B25B 15/005; B25B 23/12; B25B 15/002; B25B 15/004; B25B 23/08
See application file for complete search history.

(56) References Cited

U.S. PATENT DOCUMENTS 145,411 A 12/1873 Frearson
2,046,837 A 7/1936 Phillips
(Continued)

FOREIGN PATENT DOCUMENTS

EP 0677667 10/1995
EP 1010900 6/2000
(Continued)

OTHER PUBLICATIONS

International Search Report and Written Opinion for PCT/US2012/052084.
(Continued)

*Primary Examiner* — Robert Scruggs
(74) *Attorney, Agent, or Firm* — Kegler, Brown, Hill & Ritter, Co, LPA; Brian V. Finch

(57) ABSTRACT

A torque transmission driver is disclosed having a shaft adapted to receive and transmit torque from a torque generating source to the driver and a nib having a five or six lobe key-shape adapted to fit in a recess in a fastener, the nib being equal to or less than 0.050" in length and having lobes of substantially the same form along the entire second end portion.

10 Claims, 5 Drawing Sheets

Related U.S. Application Data continuation of application No. 13/809,122, filed as application No. PCT/US2011/043198 on Jul. 7, 2011.

(60) Provisional application No. 61/362,107, filed on Jul. 7, 2010.

(51) Int. Cl.
*B25B 23/12* (2006.01)
*B25B 23/08* (2006.01)

(52) U.S. Cl.
CPC ..... *B25B 15/008* (2013.01); *B25B 15/02* (2013.01); *B25B 23/08* (2013.01); *B25B 23/12* (2013.01)

(56) References Cited

U.S. PATENT DOCUMENTS

| | | | | |
|---|---|---|---|---|
| 2,046,838 | A | 7/1936 | Phillips | |
| 2,046,839 | A | 7/1936 | Phillips et al. | |
| 2,046,840 | A | 7/1936 | Phillips et al. | |
| 2,285,460 | A | 6/1942 | Purtell | |
| 2,397,216 | A | 3/1946 | Stellin | |
| 2,969,250 | A | 1/1961 | Kull | |
| 3,187,790 | A | 6/1965 | Wing | |
| 3,584,667 | A | 6/1971 | Reiland | |
| 3,763,725 | A | 10/1973 | Reiland | |
| 3,812,757 | A | 5/1974 | Reiland | |
| 3,884,282 | A | 5/1975 | Dobrosielski | |
| 3,888,144 | A * | 6/1975 | Parsons | B25B 15/004 411/403 |
| 4,006,660 | A | 2/1977 | Yamamoto | |
| 4,128,038 | A | 12/1978 | Urwin | |
| 4,269,246 | A | 5/1981 | Larson | |
| 4,325,153 | A | 4/1982 | Finnegan | |
| 4,528,874 | A | 7/1985 | Dunn | |
| 4,878,406 | A | 11/1989 | Simpson et al. | |
| 4,970,922 | A | 11/1990 | Krivec | |
| 5,025,688 | A | 6/1991 | Davis | |
| 5,105,690 | A * | 4/1992 | Lazzara | A61C 8/0089 81/436 |
| 5,137,407 | A | 8/1992 | Yamamoto | |
| 5,207,132 | A | 5/1993 | Goss et al. | |
| 5,224,402 | A | 7/1993 | Pettersson | |
| 5,237,893 | A | 8/1993 | Ryder et al. | |
| 5,279,190 | A * | 1/1994 | Goss | B25B 13/065 411/403 |
| 5,291,811 | A | 3/1994 | Goss | |
| 5,353,667 | A | 10/1994 | Wilner | |
| 5,367,926 | A | 11/1994 | Mikic et al. | |
| 5,435,680 | A * | 7/1995 | Schuster | B25B 13/065 411/403 |
| 5,461,952 | A | 10/1995 | Goss | |
| 5,513,933 | A | 5/1996 | Rom | |
| 6,016,727 | A | 1/2000 | Morgan | |
| 6,158,310 | A | 12/2000 | Goss et al. | |
| 6,199,455 | B1 * | 3/2001 | Wagner | F16B 23/0007 81/121.1 |
| 6,367,358 | B1 | 4/2002 | Stacy | |
| 6,378,406 | B1 | 4/2002 | Totsu | |
| 6,393,953 | B1 | 5/2002 | Totsu | |
| 6,397,710 | B1 * | 6/2002 | Baker | B25B 15/005 81/436 |
| 6,477,923 | B2 | 11/2002 | Amis | |
| 6,584,876 | B2 | 7/2003 | Totsu | |
| 6,601,482 | B2 | 8/2003 | Hughes et al. | |
| 6,685,412 | B2 | 2/2004 | Altarac et al. | |
| 6,857,340 | B2 | 2/2005 | Wagner | |
| 6,868,572 | B1 | 3/2005 | Newton | |
| 6,886,431 | B1 | 5/2005 | Petrsorich | |
| 6,886,433 | B2 | 5/2005 | Totsu | |
| 7,165,482 | B2 | 1/2007 | Shapoval | |
| 7,188,554 | B2 | 3/2007 | Baynham | |
| 7,225,710 | B2 | 6/2007 | Pacheco, Jr. | |
| 7,311,026 | B2 | 12/2007 | Melton | |
| 7,325,470 | B2 | 2/2008 | Kay et al. | |
| 7,690,282 | B2 | 4/2010 | Griffiths | |
| 7,708,767 | B2 | 5/2010 | Contiliano et al. | |
| 7,793,573 | B2 | 9/2010 | Gao | |
| 2001/0025552 | A1 | 10/2001 | Wagner | |
| 2005/0166724 | A1 | 8/2005 | Castaneda | |
| 2007/0245863 | A1 | 10/2007 | Edland | |
| 2008/0159827 | A1 | 7/2008 | Edland | |
| 2008/0226423 | A1 | 9/2008 | Brooks | |
| 2009/0260489 | A1 | 10/2009 | Siong | |
| 2010/0037737 | A1 * | 2/2010 | Pchola | B25B 15/008 81/460 |
| 2010/0129176 | A1 | 5/2010 | Karupaya | |
| 2010/0192736 | A1 | 8/2010 | Burch et al. | |
| 2010/0269644 | A1 | 10/2010 | Edland et al. | |

FOREIGN PATENT DOCUMENTS

| | | |
|---|---|---|
| JP | 60131715 | 9/1985 |
| JP | 197908 | 7/2004 |
| SU | 1745535 | 7/1992 |
| WO | 01/27479 | 4/2001 |
| WO | 2008136765 | 11/2008 |
| WO | 2009094107 | 7/2009 |
| WO | 2010101341 | 10/2010 |

OTHER PUBLICATIONS

International Search Report and Written Opinion for PCT/US2011/043198.

International Search Report for PCT/2011/043198.

Polar Handtools, Handtool Catalogue, catalog, 2009, p. 6, Polar Tools A/S, Denmark.

* cited by examiner

| Nib Length Heat Treat | .066 Std HUD | .066 Alt HUD | .066 Alt MT | .033 Std HUD | .033 Alt HUD | .033 Alt MT | Comparison |
|---|---|---|---|---|---|---|---|
| Mean | 7.552 | 7.569 | 7.284 | 9.022 | 8.591 | 8.636 | 8.478 |
| St. Dev. | 0.334 | 0.397 | 0.242 | 0.302 | 0.335 | 0.163 | 0.447 |
| Std. Dev. % of Mean | 4.4% | 5.2% | 3.3% | 3.3% | 3.9% | 1.9% | 5.3% |
| MIN | 7.006 | 7.008 | 6.967 | 8.561 | 7.825 | 8.349 | 7.845 |
| MAX | 7.996 | 8.349 | 7.562 | 9.478 | 8.944 | 8.873 | 9.357 |

| Nib Length Heat Treat | .066 Std HUD | .066 Alt HUD | .066 Alt MT | .033 Std HUD | .033 Alt HUD | .033 Alt MT | Comparison |
|---|---|---|---|---|---|---|---|
| Mean | 61 | 52 | 15 | 148 | 128 | 84 | 93 |
| St. Dev. | 14 | 12 | 5 | 23 | 6 | 31 | 137 |
| Std. Dev. % of Mean | 22.4% | 22.7% | 32.2% | 15.3% | 4.7% | 37.1% | 147.1% |
| MIN | 45 | 43 | 12 | 124 | 122 | 51 | 0 |
| MAX | 69 | 65 | 21 | 169 | 134 | 113 | 251 |
| 1 | 45 | 65 | 13 | 169 | 129 | 88 | 251 |
| 2 | 69 | 47 | 21 | 124 | 134 | 51 | 29 |
| 3 | 68 | 43 | 12 | 152 | 122 | 113 | 0 |

TORQUE TRANSMISSION DRIVER

CROSS REFERENCE TO RELATED APPLICATIONS

This application is a continuation-in-part of U.S. patent application Ser. No. 13/947,014, filed on Jul. 19, 2013, which is a continuation of U.S. patent application Ser. No. 13/809,122, filed on Apr. 23, 2013, which is a national stage application of PCT Application No. PCT/US2011/043198, filed on Jul. 7, 2011, which claims priority to U.S. Provisional patent No. 61/362,107, filed on Jul. 7, 2010, the disclosures of each of these references are herein incorporated by reference in their entirety.

BACKGROUND AND SUMMARY

The present invention is directed to an improved torque transmission driver used to transmit torque from a torque generating source, such as a power drill, to a fastener for assembly of a structure or device, most notably where the fasteners are small less than size 10.

Torque transmission drivers have been commonly used in assembling structures and devices with threaded fasteners such as screws and bolts. Such torque transmission drivers transmit the torque created by a torque generator to the fastener to thread a fastener into an assembly. Various such torque transmission drivers have been provided in the past, usually having the shape of a drive end complementary to a recess in or projections from the heads of fasteners, with which they are used. Examples are drill chucks and screw drivers.

To illustrate, U.S. Pat. No. 2,397,216 issued in 1946 discloses a number of forms or shapes of torque transmission drive systems. Known are the hex-type and cruciform-type torque transmission driver such as the PHILLIPS® torque drive system. Also, U.S. Pat. No. 3,584,667 shows a torque transmission driver which has been widely used in automotive, aerospace and appliance manufacture and marketed under the brand name TORX®. Various lobe-type torque drive systems similar to the TORX® drive system are also shown in U.S. Pat. Nos. 5,025,688, 4,269,246, 4,006,660, 3,885,480, 2,969,250 and 2,083,092 issued between 1991 and 1938. See also U.S. Patent Application Pub. No. US 2010/0129176 published May 27, 2010.

Prior art torque transmission drivers were made with the key shape of the driver well defined to engage a fastener recess at and near the terminal end of the nib, away from the first end portion of the driver for engaging the torque transmission source. The bit of the driver would transition from the key shape to engage the recess of the fastener to a shape to conform generally to the shape of the first end portion. This way of making such past drivers provided a bit on the driver to engage a fastener along a limited proportion of the nib, and requiring the torque transmission driver to have a longer nib in order to fully engage the drive recess of a fastener. This required a relatively long bit generally 0.60 inch or greater and resulted inefficient driver and method of making the driver.

Also traditional forging methods is often insufficient for precision drives having a small size, such as size 10 and smaller. Forging such drivers is not sufficiently precise so a forged nib may not properly engage the drive recess of a fastener. This may be because the lobes of the key drive or valleys there between are missized or misaligned. Further, even if the key drive is manufactured to the precise tolerances, the tapered aspect of the forged nib may result in the driver not seating properly in the drive recess of fasteners. This misalignment may not be immediately noticeable because the driver may still function to drive fasteners due to the tapered key drive or the nib. However, because of the imprecision in the key shape, the driver may wear earlier and more than expected, fasteners fastened with the driver may strip out more often, and/or the driver may not be able to tightened fasteners to a uniform or accurate torque. Moreover, particulate matter is generated during strip out and wear which is particularly harmful in electronic devices. This creates the potential for inefficiencies and losses in the use of torque transmission drivers.

Despite the previous developments in torque transmission drivers, there remains a need for a torque transmission driver with the capability to provide better torque transmission capability, and to reduce strip out of the recess of the fastener and reduce variation in driver torque failures. This need has been particularly acute and long recognized in torque transmission drivers for small fasteners less than size 10, where the recess in the head of the fastener is less than 0.100 inch, or less than 0.060 inch, in the major dimension. These torque transmission driver have been generally difficult to engage and maintain stabilized with the small fasteners during installation, have had reduced engagement with the fasteners limiting the amount of torque that could be transmitted from the driver to the fastener, and involved fine threads on the fasteners that could more readily be cross threaded and/or stripped out during installation. As a result, in the past special installation tools have had to be used for these fasteners, which in turn limited the serviceability and repair ability of the structure or device assembled using the drivers and fasteners. Moreover, because of variability in installation torque, the quality control of the assembly was difficult if not impossible to maintain with such previous transmission torque drivers. Finally, the improved driver increases the tolerances that can be maintained within the drive, and reduces particulate generation due to strip out and wear, which is particularly problematic in electronic devices.

A torque transmission driver is presently disclosed that comprises a shaft having a first end portion adapted to receive and transmit torque from a torque generating source to the driver, and a second end portion forming a nib having a five or six-lobe key-shape adapted to fit a recess in the fastener, wherein the second end portion is equal to or less than 0.050" in length and having lobes of substantially the same form along the entire second end portion.

Additionally, the key-shape with a major diameter and a minor diameter may include a taper of no greater than 55° at the base of each lobe where the second end portion of driver reaches the first portion of the driver. Further the shape of that taper may be convex.

Also disclosed is a torque transmission driver comprising in addition a protruding lead end on the second portion initiating from the key shape of the second portion and transitioning to a cross-sectional shape different from the key shape with a taper at an angle between 10° and 30° from a plane perpendicular to the drive axis of the driver and with a substantial portion thereof adapted to complement and frictionally engage at least a portion of a recess in a fastener.

In further aspects, the key-shape is sized to a size 10 or smaller driver; a size 6 or smaller driver; a M6 or smaller driver; or a M3.5 or smaller driver. Additionally, the nib may have a length equal to or less than 0.033".

Also disclosed is a method of making a torque transmission driver. The method includes the steps of providing a torque transmission driver blank including a first end portion for receiving and transmitting torque from a torque generating source, providing a second end portion forming a nib having a five or six-lobe key-shape adapted to fit a recess in the fastener where the second end portion is equal to or less than 0.050" in length and has lobes of substantially the same form along the entire second end portion the first end, forming a taper in the first end portion adjacent the second end portion extending from the key shape of the second end portion. The taper is no greater than 55° at the base of each lobe extending from the major diameter to the minor diameter. The length of the nib of the second end portion is equal to or less than 0.050" exclusive of the taper; or equal to or less than 0.030" not including the taper. The taper also may be convex.

Further, this method may include the additional step of forming a protruding lead end in the second end portion, the protruding lead end initiating from the key shape of the second end portion and transitioning to a cross-sectional shape different from the key shape with a taper at an angle between 10° and 30° from a plane perpendicular to the drive axis of the driver and with a substantial portion thereof adapted to complement and frictionally engage at least a portion of a recess in a fastener.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION OF THE DRAWINGS

Referring generally to FIGS. 1 through 6, a torque transmission driver is presently disclosed having a first end portion 102 that is adapted to transmit torque from a torque generating source, such as a power screw driver, to a fastener for assembly of a structure or device. The torque transmission driver is particularly suitable for fastening small fasteners of size 10 and smaller, or approximately 6 mm in diameter.

Figure 1A:
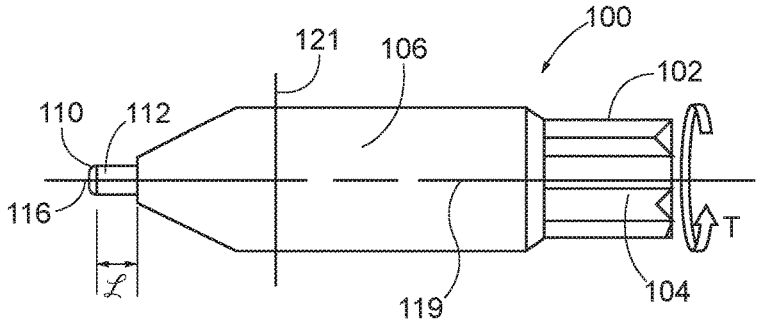
FIG. 1A is a side view of a torque transmission driver.
Figure 1B:
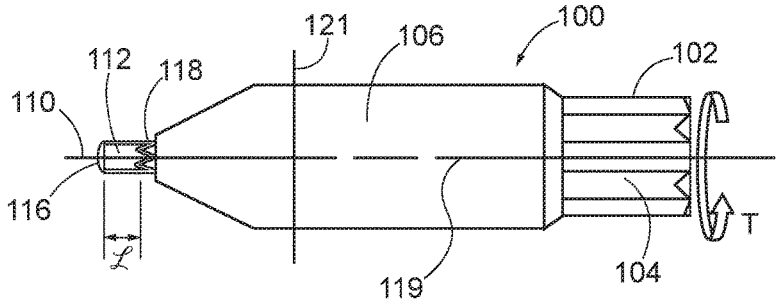
FIG. 1B is a side view of an alternative torque transmission driver.

As shown in FIGS. 1A-B, a torque transmission driver has a main body 100 having a first end portion 102 and a second end portion 110. The first end portion is adapted to receive and transmit torque T from a torque generation source (not shown). The first end portion 102 illustrated in FIGS. 1A-B is a hexagonal shank 104 capable of being secured in the chuck of a torque generation source, such as a power drill or power screw driver. Alternatively, the torque transmission driver may also be manually operated where a user provides the desired torque. A wide variety of torque generation sources are known and the first end portion may be selected to accommodate and fit one or more desired torque generation sources. For example, the first end portion may be a circular shank capable of use with a variety of configurable tools. In another alternative, the first end portion may be a handle sized to accommodate a user's hand for providing torque generation, and the main body of the torque transmission driver may form a manually operable tool. As such, the torque transmission driver presently disclosed may be adapted to transmit torque to a fastener in manual, powered, and automated applications.

Referring specifically to FIG. 1A, the second end portion 110 has a nib 112 with a key shape 114 adapted to fit a recess in a fastener and has a length L. The key shape 114 extends the length L of the nib and the nib 112 has lobes of substantially the same form along the entire length L. The length of the nib of the second end portion is equal to or less than 0.050" or less than 0.030".

The second end portion 110 may also have a protruding lead end 116 in different shape than the key shape of the second end portion having a taper adapted to match at least a portion of the recess in a fastener and assist in transmission of torque from the driver to the fastener. As shown in FIGS. 1A and 1B, the second end portion 110 may be part of the main body 106 of the torque transmission driver. As shown, the length L of the nib 112 does not include the protruding lead end 116.

Referring specifically to FIG. 1B, the second end portion may also be provided with a taper 118 in the troughs between the lobes of the key shape 114. This taper may have an angle of up to 55° and may be flat or convex. The length L of the nib 112 does not include the protruding lead end 116 or the portion of the taper 118 in the first end portion 102 of the driver.

Figure 2A:
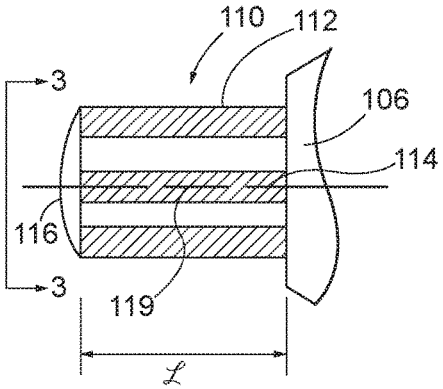
FIG. 2A is a detail view of the lead end of the torque transmission driver of FIG. 1A.
Figure 2B:
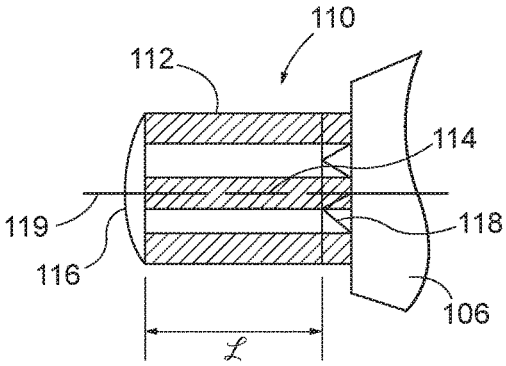
FIG. 2B is a detail view of the lead end of the torque transmission driver of FIG. 1B.

Referring to FIGS. 2A-B, the second end portion 110 of a torque transmission driver is illustrated in an enlarged elevation view. The second end portion 110 has a key shape 114 adapted to fit a recess in a fastener, and may have a protruding lead end 116 different in shape than the key shape of the second end portion. The protruding lead end 116 has a taper adapted to match at least a portion of the recess in a fastener and assist in transmission of the torque from the driver to the fastener. In any case, the length of the nib of the second end portion is equal to or less than 0.050", or equal to or less than 0.030", exclusive of the taper of the protruding lead end portion 116 and the taper 118 in the first end portion 102. The nib 112 extends from the first end portion 102 to the length L to protruding lead end 116, which extends from the terminal end of the nib 112.

The key shape 114 of the second end portion 110 is configured to transfer a torque force T (see FIG. 1A) to the bearing surfaces of a socket recess in a fastener. Second end portion 110 portion 110 may be formed in a variety of key shapes 114 to fit with five- or six-lobe recesses in fasteners to transmit torque in accordance with the present torque transmission driver. The surfaces of the key shape 114 are typically substantially parallel to the longitudinal axis 119 of the torque transmission driver or at a desired angle relative thereto. As the torque transmission driver is rotated the key portion 114 engages the walls or axial bearing surfaces of the recess in the fastener to transfer torque from the driver to the fastener.

The torque transmission driver may be particularly adapted to drive a small fastener, where the second end portion 110 has a key shape 114 adapted to fit a recess having a major dimension of up to about 0.100 inch in a fastener. For example, the key shape 114 may be the size of a T3 TORX® brand bit adapted to fit a corresponding fastener recess. Alternatively, the key shape 114 may have the size of a T1 TORX® brand bit, or smaller, adapted to fit a corresponding fastener recess. Alternatively, the second end portion may have a key shape adapted to fit like or smaller recesses, such a fastener with a recess having a major dimension of up to about 0.040 inch, or up to about 0.060 inch in a major dimension. In each instance, the configuration of the key shape is such as to fit the recess of the fastener and transmit torque from the torque transmission driver to the fastener for installing or removing the fastener in a device, structure or other assembly.

In any case, the nib 112 has a length L which may be equal to or less than 0.050" in length. Alternatively, the nib 112 has a length L which may be equal to or less than 0.030" in length. The key shape extends along the length of the nib 112 and has substantially the same form along the entire length of the nib 112. The key shape is manufactured with a tolerance of 0.010". There may be as shown a sharp right-angle break between the nib 112 and the first end portion 102 of main body 106 when the key shape 114 terminates without run-out.

Figure 3:
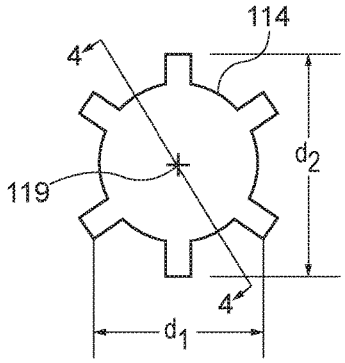
FIG. 3 is an end view of the torque transmission driver of FIG. 2A.

With reference to FIG. 2B, between the nib 112 and the first end portion 102 there may be a taper 118 provided at the base of each lobe between the minor diameter $d_1$ to the minor diameter $d_2$ (see FIG. 3). This taper 118 is not included in the length L. The taper may be of an angle of 45° or equal to or less than 55°. The angle $\alpha$ (see FIG. 4A) of the taper 118 is measured from a plane 121 perpendicular to the longitudinal axis 119 of the main body 100, whereby a larger angle represents a greater distance between the nib 112 and the first end portion 102. The taper 118 may have a flat surface, or may have a convex shape. In the case of a convex taper 118, the angle $\alpha$ of the taper 118 is measured based on the terminal ends of the taper 118 (see FIG. 4C angle $\alpha$).

With reference to FIG. 3, an end view of the torque transmission driver is shown. Illustrated in this figure is the key shape 114 of the nib 112 of the second end portion of the 110. The key-shape 114, according to this embodiment, includes six lobes substantially evenly spaced about the circumference of the nib 112. The key-shape 114 of nib 112 includes a minor diameter $d_1$ defined as the diameter centered on the longitudinal axis 119 of the driver. The key-shape 114 includes a major diameter $d_2$ defined as the diameter centered on the longitudinal axis 119 of the fastener.

Figure 4A:
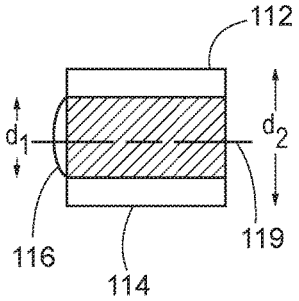
FIG. 4A is a cross-sectional view of the torque transmission driver of FIG. 2A.
Figure 4B:
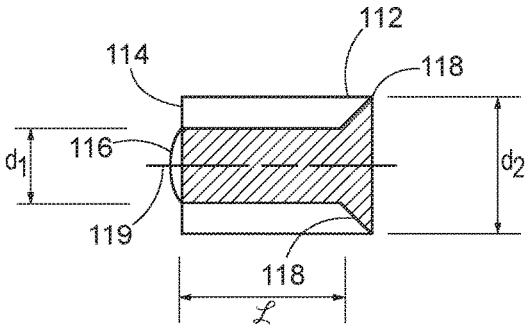
FIG. 4B is a cross-sectional view of the torque transmission driver of FIG. 2B.
Figure 4C:
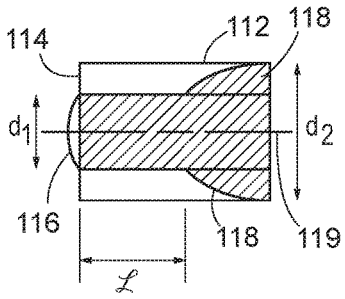
FIG. 4C is a cross-sectional view of the torque transmission according to another embodiment.

With reference to FIGS. 4A-C, a cross-sectional view of the second end portion 110 is shown. The second end portion 110 includes the nib 112 of length L, the protruding lead end 116, and (in FIGS. 4B-C) a taper 118.

According to the cross-sectional view shown in FIG. 4B, a taper 118 is provided between the minor diameter $d_1$ and the major diameter $d_2$. The taper 118 in FIG. 4B is a flat taper having an angle $\alpha$ of approximately 45°; however the taper 118 may have an angle $\alpha$ equal to or less than 55°.

According to the cross-sectional view shown in FIG. 4C, a taper 118 is provided between the minor diameter $d_1$ and the major diameter $d_2$. The taper 118 in FIG. 4C is convex having an angle $\alpha$ between terminal ends of approximately 55°, however the taper may be less than this.

In any case, the second end portion 110 of the main body may have a protruding lead end 116 as shown in FIGS. 4A-4C. The protruding lead end 116 is adapted to match at least a portion of the recess in the fastener and assist in transmitting torques from the driver to the fastener. The protruding lead end 116 may have a taper adapted to match a majority of the recess in the fastener. Alternatively, the protruding lead end 116 may be shaped to complement the recess in a fastener such that torque can be transmitted from the second portion of the main body to the fastener through the protruding lead end. The protruding lead end 116 extends from the key shape 114 of the second end portion 110. As such, the protruding lead end 116 may generally be illustrated as the end portion of the torque transmission driver may have protruding lead end 116 appropriately shaped. A rounded tip may be desirable to reduce undesired abrasions when the torque transmission driver is entering the recess in the fastener when in use and to extend the useful life of the driver.

Figure 5:
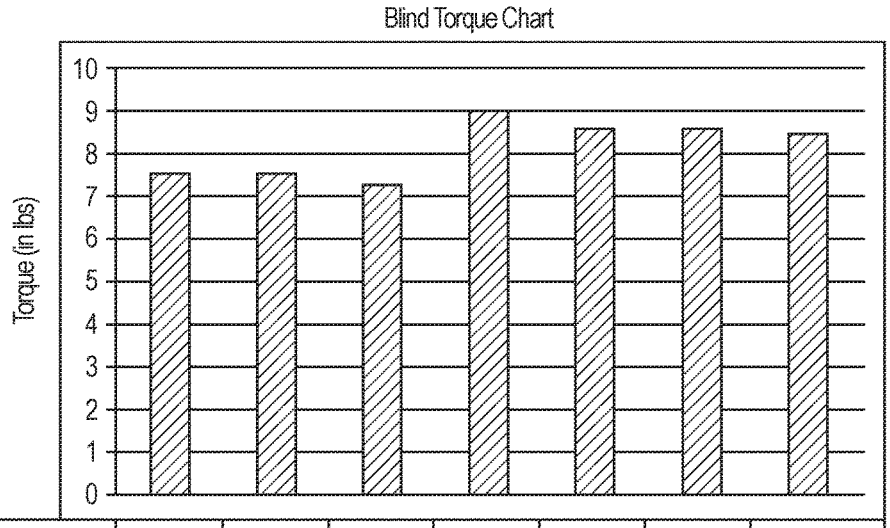
FIG. 5 is a chart comparing blind torque of various nibs.

With reference to FIG. 5, a blind torque chart is provided from comparative testing. In this comparative analysis, the performance of torque transmission drivers having nibs of various lengths L are compared, as well as heat treatment methods to deliver torque to a fastener. Drivers with nibs having a length of 0.033" of the present invention, were compared to previous heat treated drivers with nibs having a length of 0.066". As shown in this chart, the length of the nib was shown to have a marked impact on the ability of the torque transmission driver to deliver torque to a fastener. The torque transmission drivers having shorter nibs were shown to have an increase of 1-1.5 inch-pounds over those with nibs of previous length. This represents an increased torque delivery of 10-20% over of drivers of the present invention compared to previous drivers of standard nib length.

Figure 6:
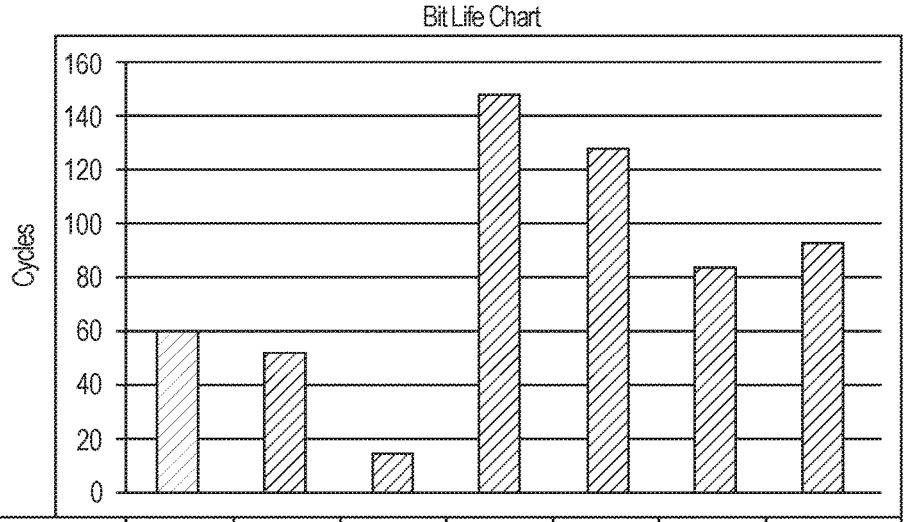
FIG. 6 is a chart comparing bit life of various nibs.
Figure 7A:
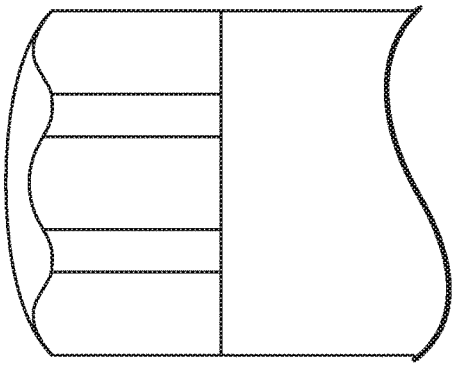
FIG. 7A is a photograph showing the torque transmission driver of FIG. 2A.
Figure 7B:
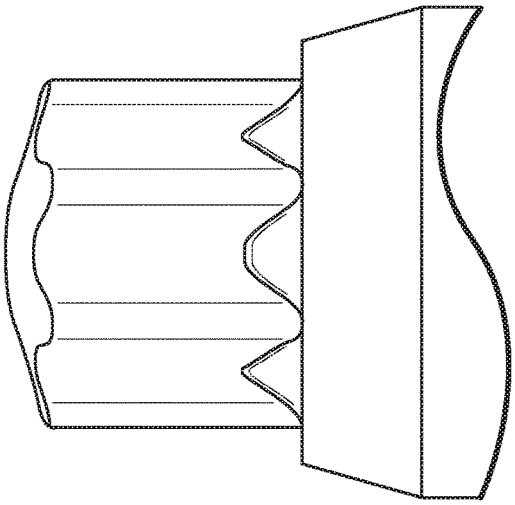
FIG. 7B is a photograph showing the torque transmission driver of FIG. 2B.

In addition, the bit life of the torque transmission drivers having various nib lengths L were compared and the results with those of drivers of the invention are illustrated in FIG. 6. Drivers with nibs having a length of 0.033" of the present invention were compared to previous heat treated drivers with nibs having a length of 0.066". As shown in this figure, torque transmission drivers having a shorter nib length (0.033") showed an increase from 70-80 cycles, representing an increase of 100-400%.

The nib length of 0.066" was chosen as a previous standard while the nib length of 0.033" was chosen as representing the minimum recess depth of a fastener plus 0.006". As shown by FIGS. 5-6, the decrease in nib length of the present invention corresponds to better strength (represented by the ability to deliver blind torque) and less fatigue (represented by the number of cycles before failure).

The torque transmission driver presently disclosed may permit faster installation by improving the ability of the driver to seat in a fastener recess, and therefore reduce the driver to recess marriage time and maintain the connection. The present torque transmission driver may also provide improved torturing capability over standard drivers, reduce strip out of fastener recesses, and reduce variation of driver torque to failure providing more consistent and reliable insertion of fasteners into work pieces or assemblies. The torque transmission driver may also provide improved tool life over prior drivers.

To illustrate the benefits of the present torque transmission driver, a driver torque to failure test was performed using a torque transmission driver of the present disclosure, and compared with the drive torque to failure of three prior driver designs. The results are shown in Table 1 below.

TABLE 1

| Sample # | Cross | Torx | Flat | Cone |
|---|---|---|---|---|
| 1 | 1.157* | 1.597** | 1.973+ | 1.774+ |
| 2 | 0.962* | 1.590** | 2.046* | 1.661+ |
| 3 | 1.044* | 1.588** | 1.956+ | 1.719+ |
| 4 | 1.290* | 1.573** | 1.840+ | 1.661+ |
| 5 | 1.011* | 1.925** | 1.630+ | 1.701+ |
| 6 | 0.916* | 1.597** | 1.845+ | 1.644+ |
| 7 | 1.082* | 1.635** | 1.743+ | 1.748+ |
| 8 | 0.933* | 1.785** | 1.763+ | 1.719** |
| 9 | 1.119* | 1.661** | 1.825+ | 1.752+ |
| 10 | 1.077* | 1.734** | 1.714+ | |
| | Samples | | | |
| | 10 | 10 | 10 | 9 |
| MEAN | 1.059 | 1.669 | 1.834 | 1.709 |
| STD DEV | 0.113 | 0.114 | 0.129 | 0.046 |
| X +3STD | 1.399 | 2.01 | 2.219 | 1.846 |
| X −3STD | 0.719 | 1.327 | 1.448 | 1.572 |
| Maximum | 1.29 | 1.925 | 2.046 | 1.774 |
| Minimum | 0.916 | 1.573 | 1.63 | 1.644 |

*Recess Failure
**Bit Failure
+Thread Failure

Referring to Table 1, three prior driver designs were tested, including "Cross" (JCIS or PHILLIPS® screwdriver), "Torx" (conventional TORX® driver), and "Flat". The "Flat" was a design having a flat end without a protruding lead end 24. The "Cone" represents a torque transmission driver of the present invention where the protruding lead end 24 comprises a cone configuration as previously discussed. As seen in Table 1, each test of the Cross driver resulted in failure of the fastener recess. Each test of the TORX® driver resulted in failure of the driver bit. The standard deviation of the drive torque to failure of the presently disclosed driver was approximately 60% improved as compared to the prior art drivers.

While certain embodiments have been described, it must be understood that various changes may be made and equivalents may be substituted without departing from the spirit or scope of the present disclosure. In addition, many modifications may be made to adapt a particular situation or material to the teachings of the disclosure without departing from its spirit or scope.

What is claimed is:

1. A torque transmission driver comprising:

a shaft for receiving and transmitting torque from a torque generating source;

a nib as part of the shaft having a key-shape adapted to fit a recess in a fastener extending along the entire length of the nib, and a length equal to or less than 0.050";

a protruding lead end initiating from the key shape of the nib and transitioning to a cross-sectional shape different from the key shape with a taper at an angle between 10° and 30° from a plane perpendicular to the drive axis of the driver and with a substantial portion thereof adapted to complement and frictionally engage at least a portion of a recess in a fastener; and a mean torque to failure value, wherein the mean torque to failure value has a standard deviation, and that standard deviation is less than approximately 7% of the mean torque to failure value.

2. The torque transmission driver of claim 1 wherein the key-shape has a major diameter and a minor diameter.

3. The torque transmission driver as set forth in claim 2 comprising in addition a taper of no greater than 55° in the shaft at the base of each lobe extending from the nib.

4. The torque transmission driver as set forth in claim 3 where the surface of the taper is convex.

5. The torque transmission driver as set forth in claim 1 wherein the key-shape is sized to size 10 or smaller driver.

6. The torque transmission driver as set forth in claim 1 wherein the key-shape is sized to size 6 or smaller driver.

7. The torque transmission driver as set forth in claim 1 wherein the key-shape is sized to a M6 or smaller driver.

8. The torque transmission driver as set forth in claim 1 wherein the key-shape is sized to a M3.5 or smaller driver.

9. The torque transmission driver as set forth in claim 1 wherein the nib is equal to or less than 0.030".

10. The torque transmission driver as set forth in claim 9 wherein the key shape has a tolerance of 0.010".

* * * * *